US006403869B2

(12) United States Patent
May

(10) Patent No.: US 6,403,869 B2
(45) **Date of Patent: *Jun. 11, 2002**

(54) CARRIER ASSEMBLY FOR PERCUSSION INSTRUMENTS

(76) Inventor: Randall L. May, 8 Windsor, Newport Beach, CA (US) 92660

( * ) Notice: Subject to any disclaimer, the term of this patent is extended or adjusted under 35 U.S.C. 154(b) by 0 days.

This patent is subject to a terminal disclaimer.

(21) Appl. No.: 09/756,479

(22) Filed: Jan. 8, 2001

Related U.S. Application Data

(63) Continuation-in-part of application No. 08/588,244, filed on Jan. 18, 1996, now Pat. No. 5,691,492.

(51) Int. Cl.[7] ..... G10D 13/02; G10G 5/00
(52) U.S. Cl. ..... 84/421; 84/453
(58) Field of Search ..... 84/104, 403, 411 R, 84/421, 453

(56) References Cited

U.S. PATENT DOCUMENTS 5,520,292 A * 5/1996 Lombardi ..... 84/421
6,172,290 B1 * 1/2001 May ..... 84/421

* cited by examiner

*Primary Examiner*—Marlon T. Fletcher

(57) ABSTRACT

Novel hardware is disclosed for supporting drums. The hardware is of a hinged construction and has one part of the hinge connectable to an external support, e.g., J-rods on a fixed pedestal support or a marching drum carrier, and another part of the hinge connectable to the shell of a drum or to the tension rods on a drum or to other supporting hardware installed on the drum. A hinged support for one or more drums having means for adjusting the position of a drum to a fixed support or drum carrier. The hinged support may be for an array of drums having means for adjusting the position of the drum array pivotally and inwardly and outwardly relative to fixed drums. The hinged support may include J-rod supports. The hinged support includes a back bar and drums are adjustably supported thereon and J-rod supports are adjustably supported on the back bar. The back bar may be adjustable in length for adjusting the location of drums supported thereon. The hardware may have means for pivotally adjusting the position of one drum in a drum array relative to another.

17 Claims, 15 Drawing Sheets

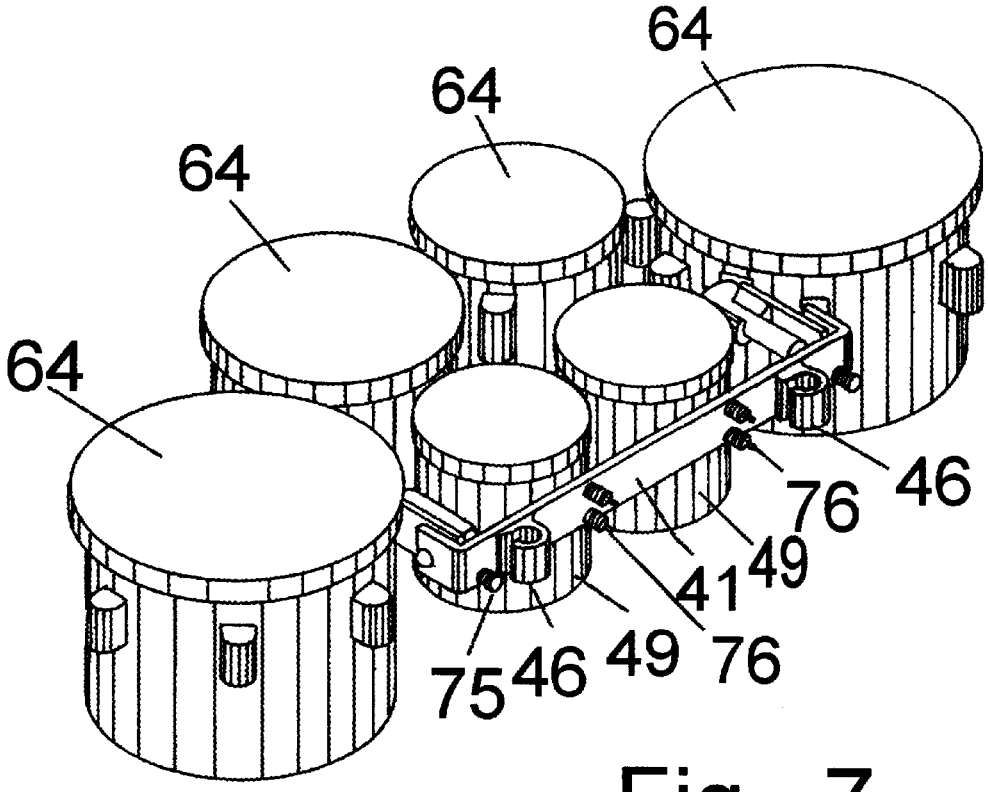
Fig. 7
Fig. 8
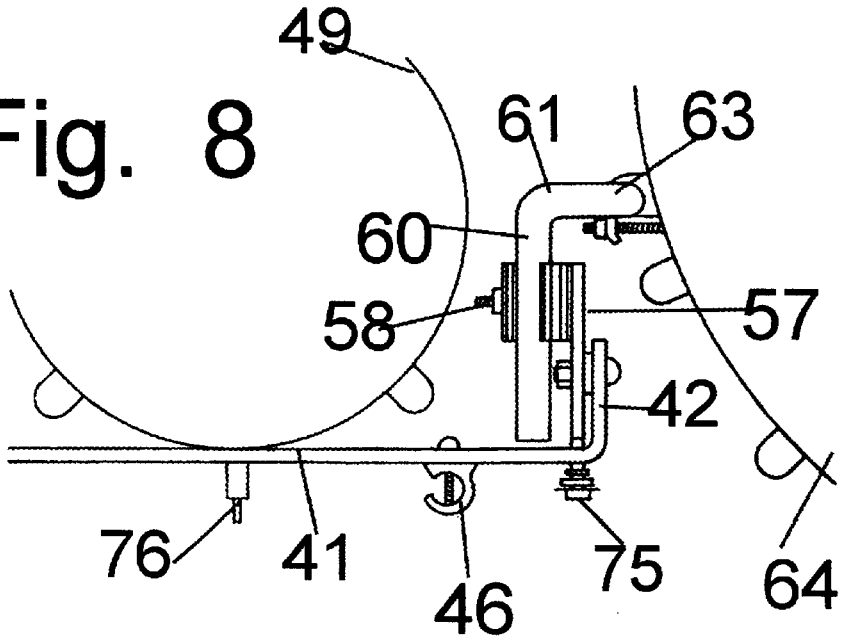

CARRIER ASSEMBLY FOR PERCUSSION INSTRUMENTS

CROSS REFERENCE TO RELATED APPLICATION

This application is a continuation-in-part of Ser. No. 08/588,244 filed Jan. 18, 1996, now U.S. Pat. No. 5,691,492.

BACKGROUND OF THE INVENTION

1. Field of the Invention

This invention relates to new and useful improvements in apparatus for supporting or carrying percussion instruments, particularly drums of various kinds.

2. Brief Description of the Prior Art

The prior art discloses many examples of apparatus for supporting percussion instruments but none providing the combination of features disclosed and claimed herein.

May U.S. Pat. No. 5,691,492 discloses hardware for supporting drums that is of a hinged construction and has one part of the hinge connectable to an external support, e.g., J-rods on a fixed support or a marching drum carrier, and another part of the hinge connectable to the shell of a drum or to the tension rods on a drum or to other hardware on the drum.

May U.S. Pat. No. 6,028,257 shows drum hardware and drums secured thereon preferably supported on a vest type carrier or a T-bar carrier or a fixed post or pedestal.

May U.S. Pat. No. 6,172,290 shows a hinged support for an array of drums.

Other possibly relevant prior art is Pyle U.S. Pat. No. 5,054,357; May U.S. Pat. No. 5,072,910 and May U.S. Pat. No. 5,300,810.

SUMMARY OF THE INVENTION

One of the objects of this invention is to provide a new and improved hinged support for an array of drums for support on a pedestal or marching type carrier.

Another object of the invention is to provide a new and improved hinged support for an array of drums for support on a pedestal or marching type carrier having means for adjusting the position of a drum array relative to fixed drums thereon.

Another object of the invention is to provide a new and improved hinged support for an array of drums for support on a pedestal or marching type carrier having means for adjusting the position of a drum array pivotally and inwardly and outwardly relative to fixed drums thereon.

Another object of the invention is to provide a new and improved hinged support for an array of drums for support on a pedestal or marching type carrier having novel means for supporting the drums thereon.

Another object of the invention is to provide a new and improved hinged support for drums for support on a pedestal or marching type carrier by J-rod supports.

Another object of the invention is to provide a new and improved means for connecting a hinged support for an array of drums for support on individual drums.

Another object of the invention is to provide a new and improved hinged support having a back bar for supporting an array of drums for support on a pedestal or marching type carrier in which drums are adjustably supported on the back bar and having J-rod supports adjustable supported on the back bar.

Another object of the invention is to provide a new and improved hinged support having a back bar for supporting an array of drums for support on a pedestal or marching type carrier in which the back bar is adjustable in length for adjusting the location of drums thereon.

Another object of the invention is to provide a new and improved hinged support for an array of drums for support on a pedestal or marching type carrier having means for pivotally adjusting the position of one drum in the array relative to another.

Other objects of the invention will become apparent throughout the specification and claims as hereinafter related.

BRIEF DESCRIPTION OF THE DRAWINGS

FIG. 7 is an isometric view of another embodiment of supporting hardware supporting an array of drums, as in a marching drum assembly.

FIG. 8 is a top detail view of the hardware and a portion of the drums as shown in FIG. 7.

DESCRIPTION OF PRIOR ART SUPPORTS FOR THE DRUM SUPPORTING HARDWARE OF THIS INVENTION

Figure 1:
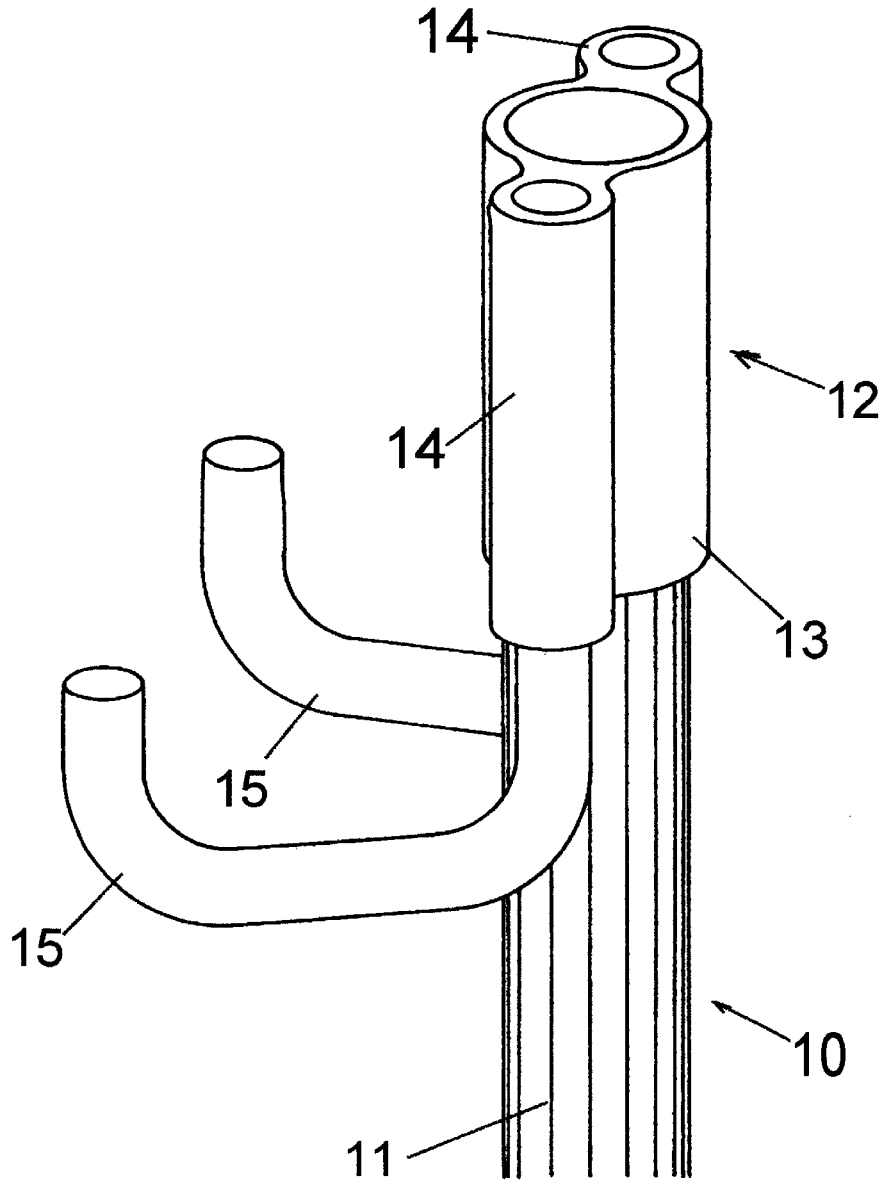
FIG. 1 is an isometric view of a pedestal support and J-bars for supporting a drum and supporting hardware as described below.
Figure 2:
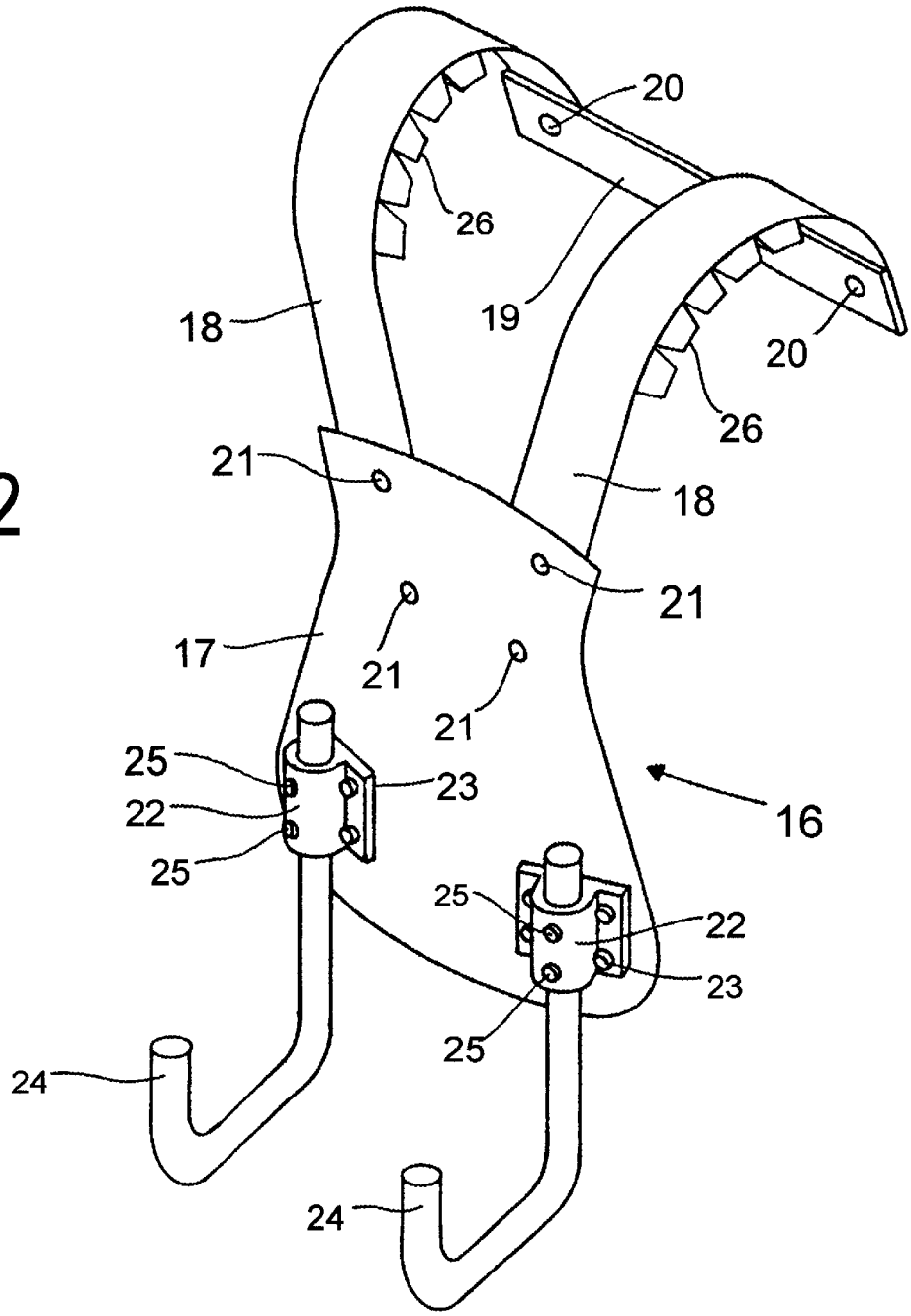
FIG. 2 is an isometric view of a supporting vest and J-bars for supporting marching drum assemblies as described below.
Figure 3:
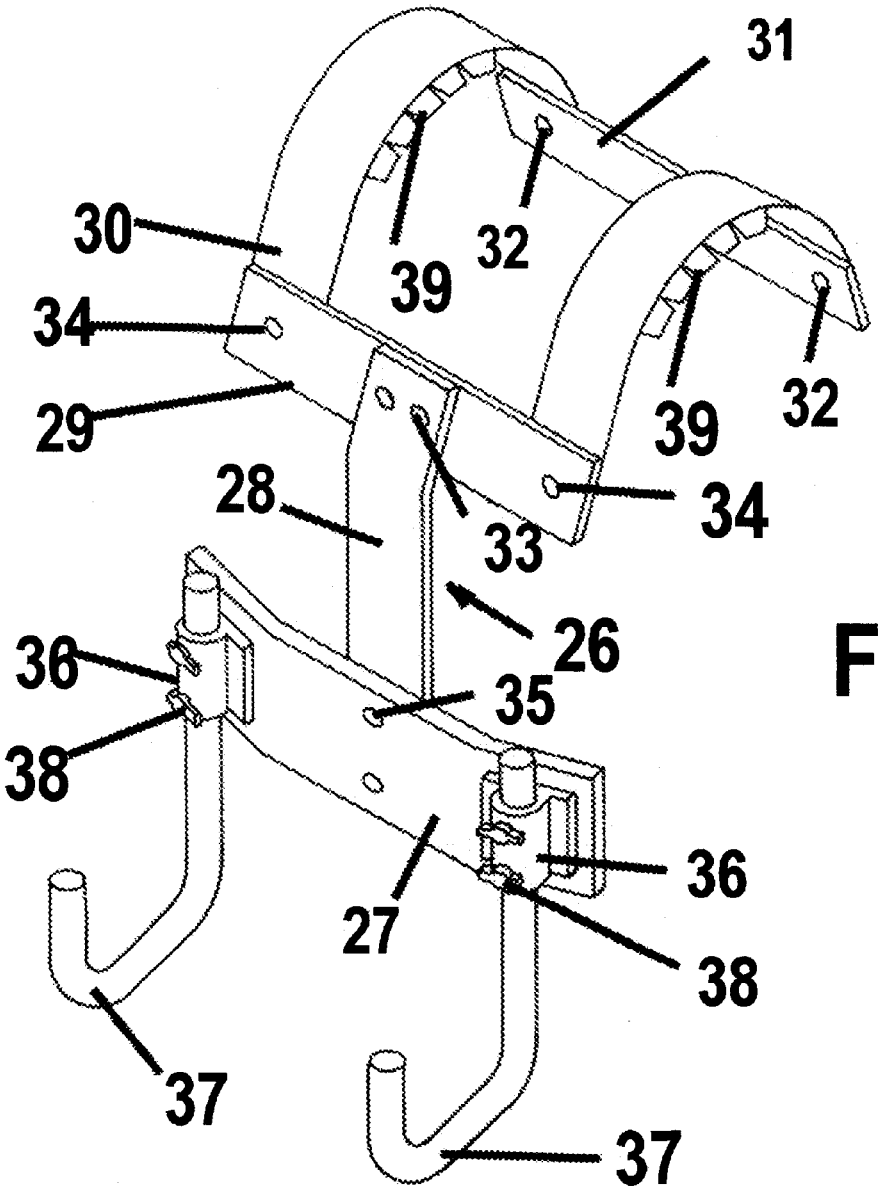
FIG. 3 is an isometric view of a novel T-bar assembly and J-rods for supporting drums containing features of the supporting vest of FIG. 2 for marching drums as described below.

FIGS. 1–3 illustrate prior art devices for supporting the drum hardware shown in FIGS. 4–24.

In FIG. 1, there is shown a drum support 10 comprising a vertically extending post 11 of a tripod (not shown) such as that shown in May U.S. Pat. No. 5,072,910. A bracket 12 has a center receptacle 13 supported on post 11 and side receptacles 14 that receive and support J-rods 15.

Referring to FIG. 2, there is shown a vest- or harness-type 16 carrier for percussion instruments which comprises a vest portion 17, shoulder straps 18 and back bar 19. Back bar 19 is removably secured to shoulder straps 18 by screws or bolts 20. Where desired, back bar 19 may be fixed as by welding or the like. Vest portion 17 is removably secured to shoulder straps 18 by screws or bolts 21 and has a pair of J-bar receptacles 22 secured by screws or bolts 23. J-bars 24 are supported in receptacles 22 and secured in position by T-bolts or set screws 25. J-bar receptacles may also be used of the type shown in FIGS. 38–41 and 51–55 of May U.S. Pat. No. 6,028,257. Shoulder straps 18 have pads 26 to cushion the load of the instruments carried by carrier 16. This carrier 16 is constructed and used as in May U.S. Pat. No. 5,691,492.

Referring to FIG. 3, there is shown a T-bar-type carrier 26 for percussion instruments which comprises a belly plate 27, vertical bar 28, upper horizontal bar 29, shoulder straps 30 and back bar 31. Back bar 31 is removably secured to shoulder straps 30 by screws or bolts 32. Where desired, back bar 31 may be fixed as by welding or the like. Upper horizontal bar 29 is removably secured to shoulder straps 30 by screws or bolts 34. Upper horizontal bar 29 is removably secured to the upper end of vertical bar 28 by screws or bolts 33.

Belly plate 27 is removably secured to the lower end of vertical bar 28 by screws or bolts 35. A pair of J-bar receptacles 36 are secured on belly plate 27 by screws or bolts or the like. J-bar receptacles may also be used of the type shown in FIGS. 38–41 and 51–55 of May U.S. Pat. No. 6,028,257. J-bars 37 are supported in receptacles 36 and secured in position by T-bolts 38. Shoulder straps 30 have pads 39 to cushion the load of the instruments carried by T-bar carrier 26. This carrier 26 is constructed and used as in May U.S. Pat. No. 5,691,492.

An Embodiment for Supporting Multiple Drum Assemblies

A hinge assembly 39 (FIGS. 4–6) is provided for supporting a multiple drum assembly or array 40 as used in marching bands. Hinge assembly 39 is similar in function to that shown in FIGS. 13–17 of May U.S. Pat. No. 6,028,257 with features permitting adjustability that is not possible in the embodiment of the patent. Multiple drum assembly or array 40 comprises a plurality, typically 2–6, of drums secured together for support and carrying by a drummer as in a marching band. In this embodiment, hinge assembly 39 provides a hinged support between the drum assembly 40 and a suitable marching carrier 16 or 26 as shown in FIGS. 2 and 3 or a fixed post support 11 as shown in FIG. 1.

Hinge assembly 39 (FIGS. 4–6) comprises a back bar 41 that is the fixed member of the hinge. Back bar 41 has end portions 42, bent at a right angle thereto, with holes 43 providing a pivot for the hinge. Holes 44 in each end of back bar 41 have bolts 45 inserted therethrough to secure J-rod receptacles 46 in place for supporting hinge assembly 39 on J-rods 15, 24, 37 on the supports shown in FIGS. 1–3. Holes 47 in back bar 41 provide for connection of one or more drums 48 (FIG. 4) and 49 (FIG. 7) by bolts 76.

Figure 6:
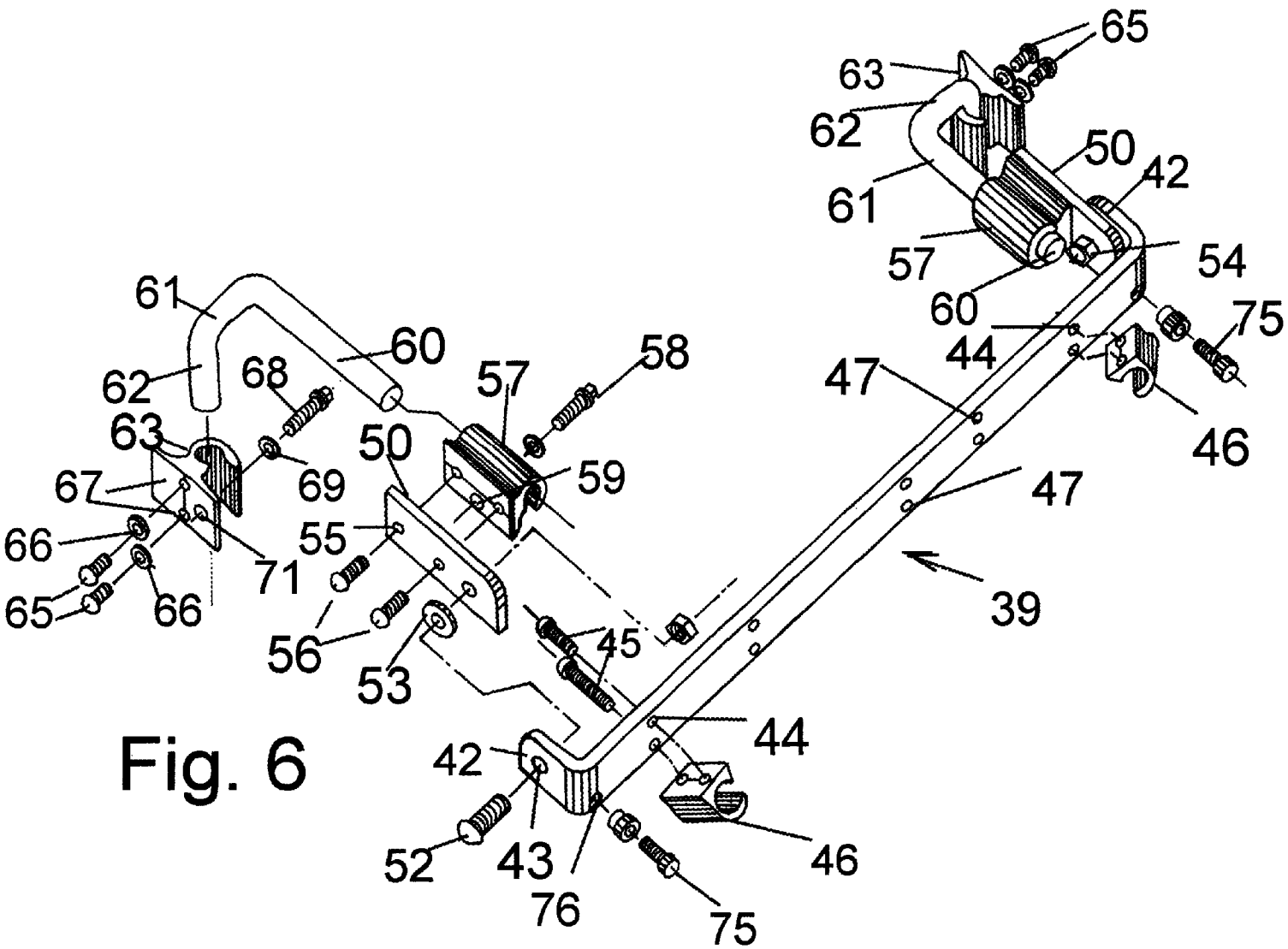
FIG. 6 is an exploded isometric view of the hinge for the drums and hardware of FIGS. 4 and 5.

In FIG. 6, the left side of the drawing shows the components in exploded relation while the right side shows them assembled. Hinge bars 50 are secured for rotation at each end of back bar 41 on bent end portions 42. Each hinge bar 50 has a hole 51 which receives bolt 52 extending through hole 43 and washer 53 and secured in place by nut 54. Each hinge bar 50 has a pair of holes 55 through which bolts 56 extend to secure clamping receptacle 57 thereon. Bolt 58 extends through receptacle 57 into hole 59 to tighten or loosen the clamp.

The end portion 60 of connecting rod 61 is secured in clamping recepticle 57. Another end portion 62 of connecting rod 61 fits into and is clamped by clamping receptacle 63 which is secured on one of the drums 64 of drum assembly 39. Drum 64 has holes that receive bolts 65 extending through washers 66 into holes 67 in the base of clamping receptacle 63. Bolt 68 extends through washer 69 and hole 70 in receptacle 63 into hole 71 to tighten or loosen the clamp. This clamping receptacle is available commercially and is described more completely in FIGS. 39–41, 47–49, and 52–55 of May U.S. Pat. No. 6,028,257.

Each hinge bar 50 is pivoted on bolts 52 to a selected position. Each hinge bar 50 has an end portion cut in curvature 72 permitting the edge to clear back bar 41. A set bolt 75 extends through hole threaded 76 in back bar 41 to engage the end portion 72 of hinge bar 50 to secure the hinge in a selected position.

Figure 4:
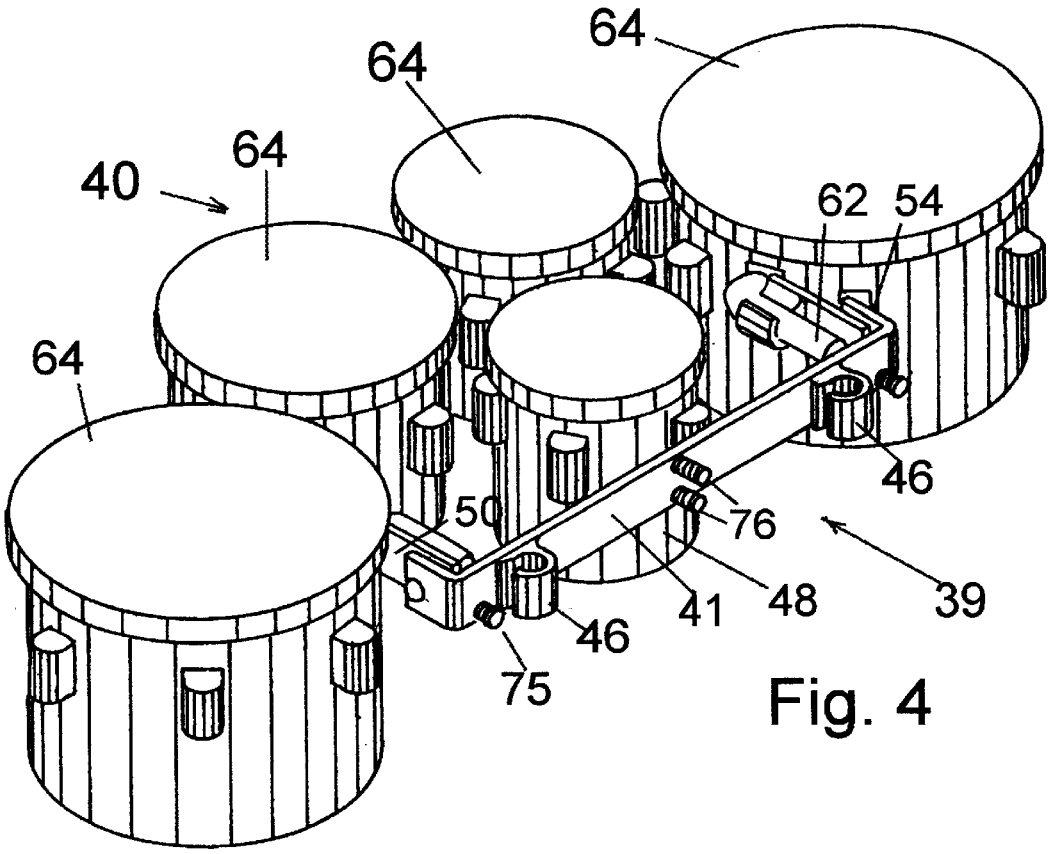
FIG. 4 is an isometric view of one embodiment of supporting hardware supporting an array of drums, as in a marching drum assembly.

In the assembly shown in FIG. 4, the array 40 of drums 64 are secured together and to hinge bars 50 for pivotal movement relative to drum 48 supported on the back bar. The clamping receptacles 57 are releasable to permit sliding adjustment of connecting rods 61 and the drum array 40 supported thereon inward and outward relative to back bar 41 and drum 48. The individual drums 64 of drum array 40 are preferable larger drums ranging about 8"–14" in diameter. Drum 48 on back bar 41 is preferably a smaller drum about 6" in diameter.

Figure 5:
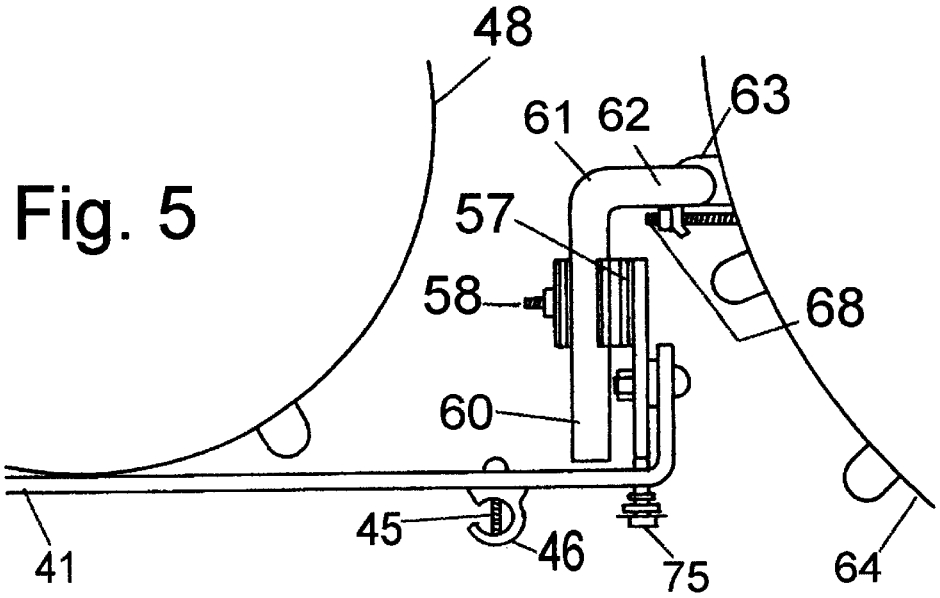
FIG. 5 is a top detail view of the hardware and a portion of the drums as shown in FIG. 4.

In FIGS. 7 and 8 the hinge construction and operation are as described for FIGS. 4–6, above, but there are two drums 48 and 49 secured on the back bar 41 by bolts 76. The bolts 76 preferably have a square head for adjustment by a drum key (not shown).

Operation

The operation of this supporting hardware should be apparent but will be described in some detail for clarity of understanding. Referring to FIGS. 4–8, the array of drums 40 is installed on J-rod clamps 63 as described above. The tenor drums 48 and 49 are secured on hinge back bar 41. In this position, the drum array 40 can be tilted relative to the drums 48 and 49 of hinge back bar 41. The connection of J-bar receptacle 57 permits the array of drums 40 to be adjusted inward and outward of the drums 48 and 49 on hinge back bar 47.

Another Embodiment for Supporting Multiple Drum Assemblies

A hinge assembly 79 (FIGS. 9–12) is provided for supporting a multiple drum assembly or array 80 as used in marching bands. Hinge assembly 79 is similar in function to that shown in FIGS. 4–6 described above but utilizes a different arrangement for adjustment. Multiple drum assembly or array 80 comprises a plurality, typically 2–6, of drums secured together for support and carrying by a drummer as in a marching band. In this embodiment, hinge assembly 79 provides a hinged support between the drum assembly 80 and a suitable marching carrier 16 or 26 as shown in FIGS. 2 and 3 or a fixed post support 11 as shown in FIG. 1.

Hinge assembly 79 (FIGS. 9–12) comprises a back bar 81 that is the fixed member of the hinge. Back bar 81 has end portions 82, bent at a right angle thereto, with holes providing a pivot for the hinge. The holes in each end of back bar 81 have bolts inserted therethrough to secure J-rod receptacles 86 in place for supporting hinge assembly 79 on J-rods 15, 24, 37 on the supports shown in FIGS. 1–3. Holes 87 in back bar 81 provide for connection of one or more drums 88 (FIG. 9) and 89 (FIG. 11) by bolts 116.

In FIG. 9–12, the components are shown in assembled relation with all of the drums in place. Hinge bars 90 are secured for rotation at each end of back bar 81 on bent end portions 82. Back bar 79 has a hole that receives bolt 92 extending therethrough secured in place by nut 94. Back bar 79 has holes through which bolts extend to secure J-rod receptacle 86.

A U-shaped clamping bar 101 has a short rebent portion 102 for connection to drum 104 by bolts 105. The clamping bar 101 has a longer rebent portion 106 having a slot 107. Slot 107 is aligned with hinge bar 90 and secured together by bolts 108 and nuts 109. This slotted connection between hinge bar 90 and clamping bar 101 provides inward and outward adjustment in position of the drum array 80 in the same manner as the connecting rod 61 and clamping receptacle 57 in FIGS. 4–8. If more adjustment is required, hinge bar 90 maybe slotted to increase the amount of movement permitted.

Each hinge bar 90 has an end portion cut in curvature 112 permitting the edge to clear back bar 81. A set bolt 115 extends through a hole in back bar 81 to engage the end of hinge bar 90 on one of the flats to secure the hinge in a selected position.

Figure 9:
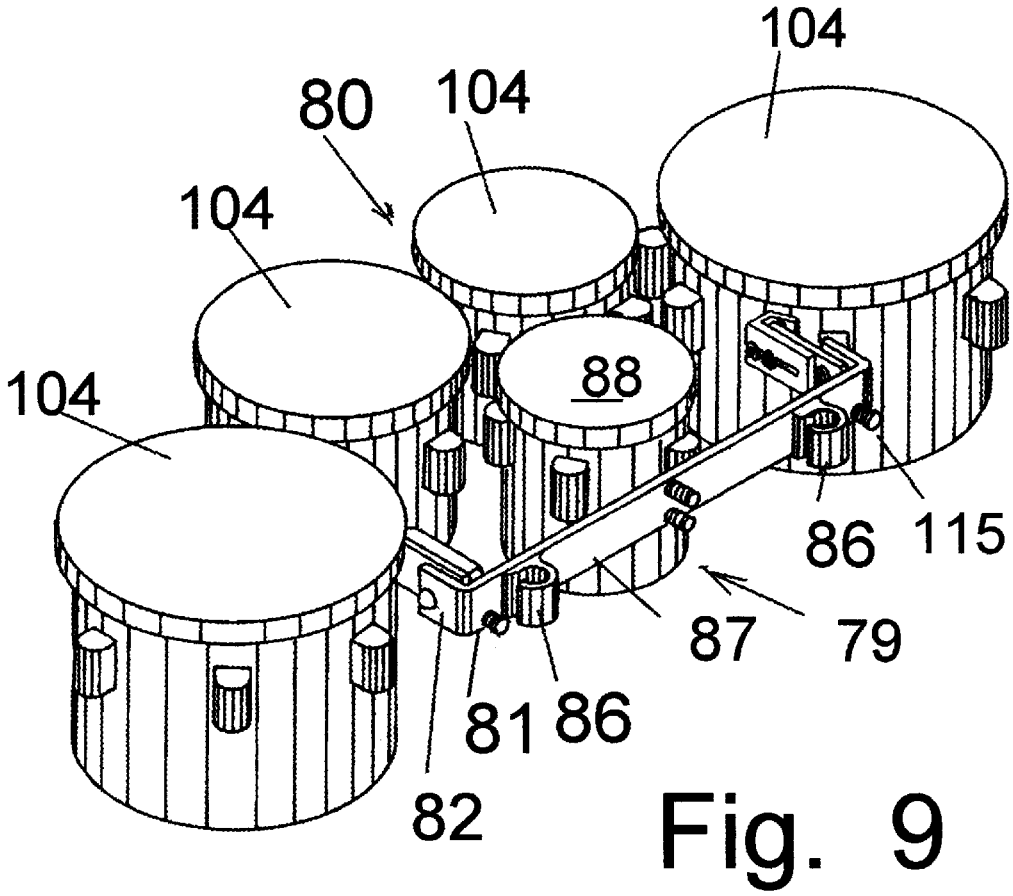
FIG. 9 is an isometric view of still another embodiment of supporting hardware supporting an array of drums, as in a marching drum assembly.

In the assembly shown in FIG. 9, the array 80 of drums 104 are secured together and to hinge bars 90 for pivotal movement relative to drum 88 supported on the back bar. The slotted connection between hinge bar 90 and U-shaped clamping bar 101 is releasable to permit sliding adjustment of the drum array 80 supported thereon inward and outward relative to back bar 81 and drum 88. The individual drums 104 of drum array 80 are preferably larger drums ranging about 8"–14" in diameter. Drum 88 on back bar 81 is preferably a smaller drum about 6" in diameter.

Figure 10:
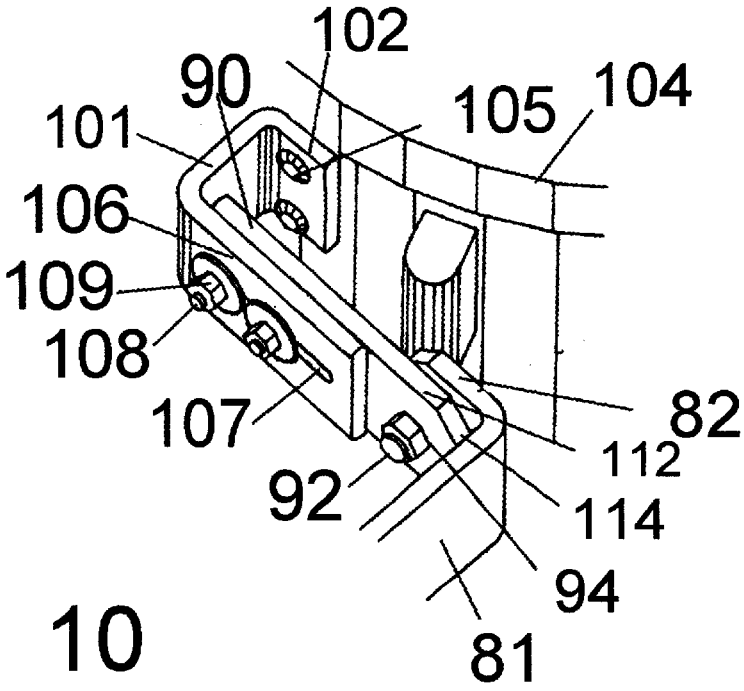
FIG. 10 is a top detail view of the hardware and a portion of the drums as shown in FIG. 9.
Figure 11:
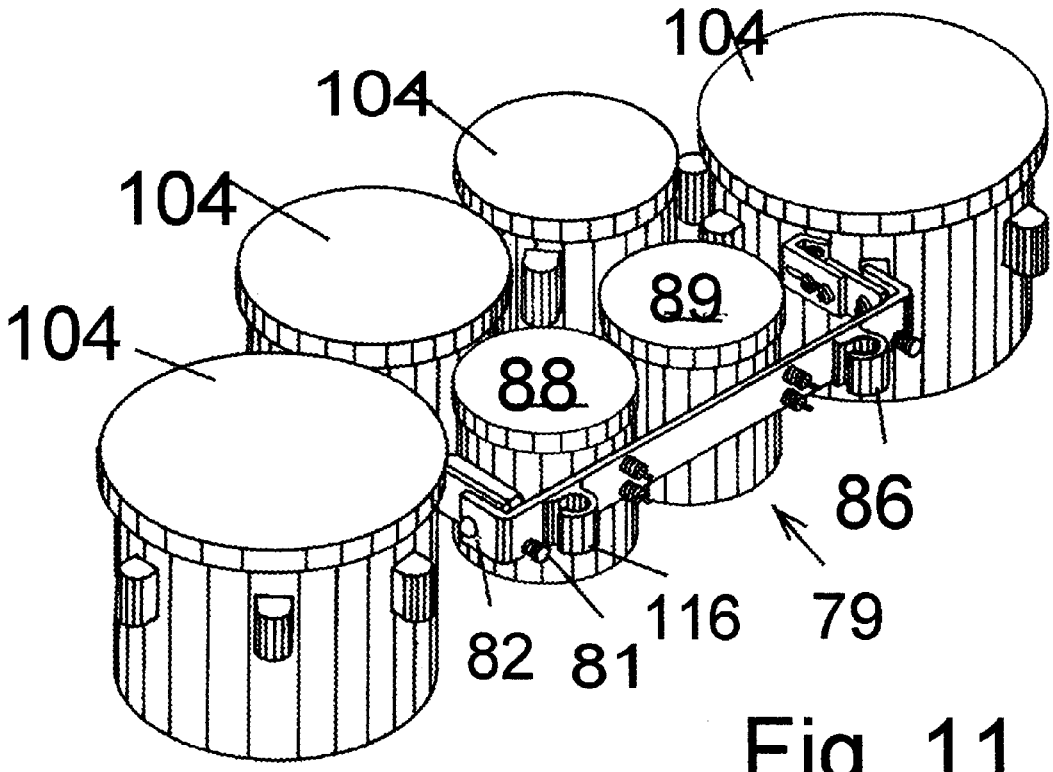
FIG. 11 is an isometric view of still another embodiment of supporting hardware supporting an array of drums, as in a marching drum assembly.
Figure 12:
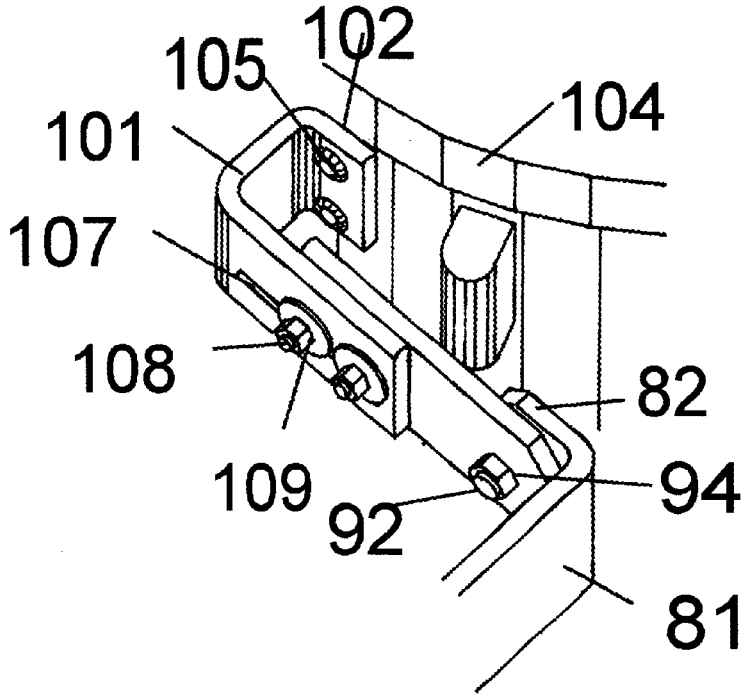
FIG. 12 is a top detail view of the hardware and a portion of the drums as shown in FIG. 11.

In FIGS. 11 and 12 the hinge construction and operation are as described for FIGS. 9 and 10, above, but there are two drums 88 and 89 secured on the back bar 81 by bolts 116. The bolts 116.preferably have a square head for adjustment by a drum key (not shown). The slotted connections in FIGS. 10 and 12 show the extent of inward and outward adjustment of the drum array 80 relative to hinge back bar 79.

Operation

The operation of this supporting hardware should be apparent but will be described in some detail for clarity of understanding. Referring to FIGS. 9–12, the array of drums 80 is installed on the pivotable hinge bars 101 as described above. The tenor drums 88 and 89 are secured on hinge back bar 87. In this position, the drum array 80 can be tilted relative to the drums 88 and 89 of hinge back bar 87. The slotted connection of hinge bars 101 and 90 permits the array of drums 80 to be adjusted inward and outward of the drums 88 and 89 on hinge back bar 87.

Connection of the Drums(s) to the Hinge Back Bar

Figure 13:
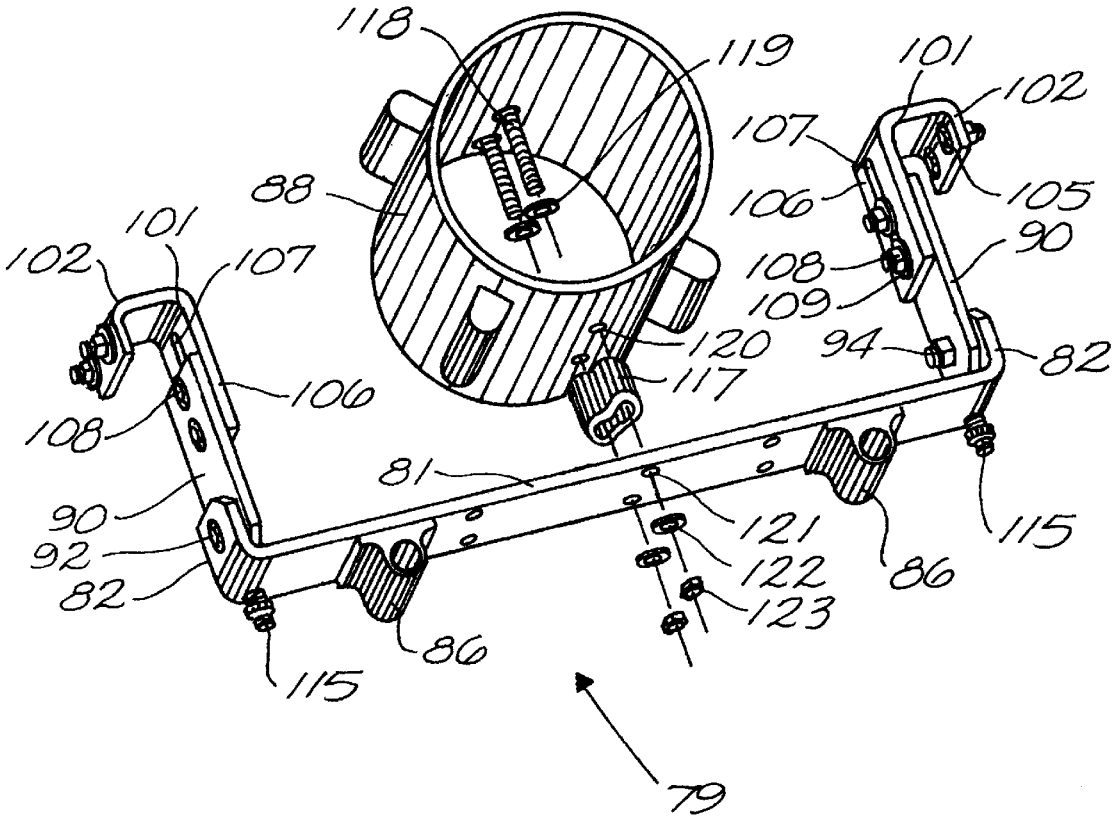
FIG. 13 is an isometric view of still another embodiment of supporting hardware supporting an array of drums, as in the marching drum assembly shown in FIG. 9 illustrating the hardware for connection of one drum to the back bar of the support.
Figure 14:
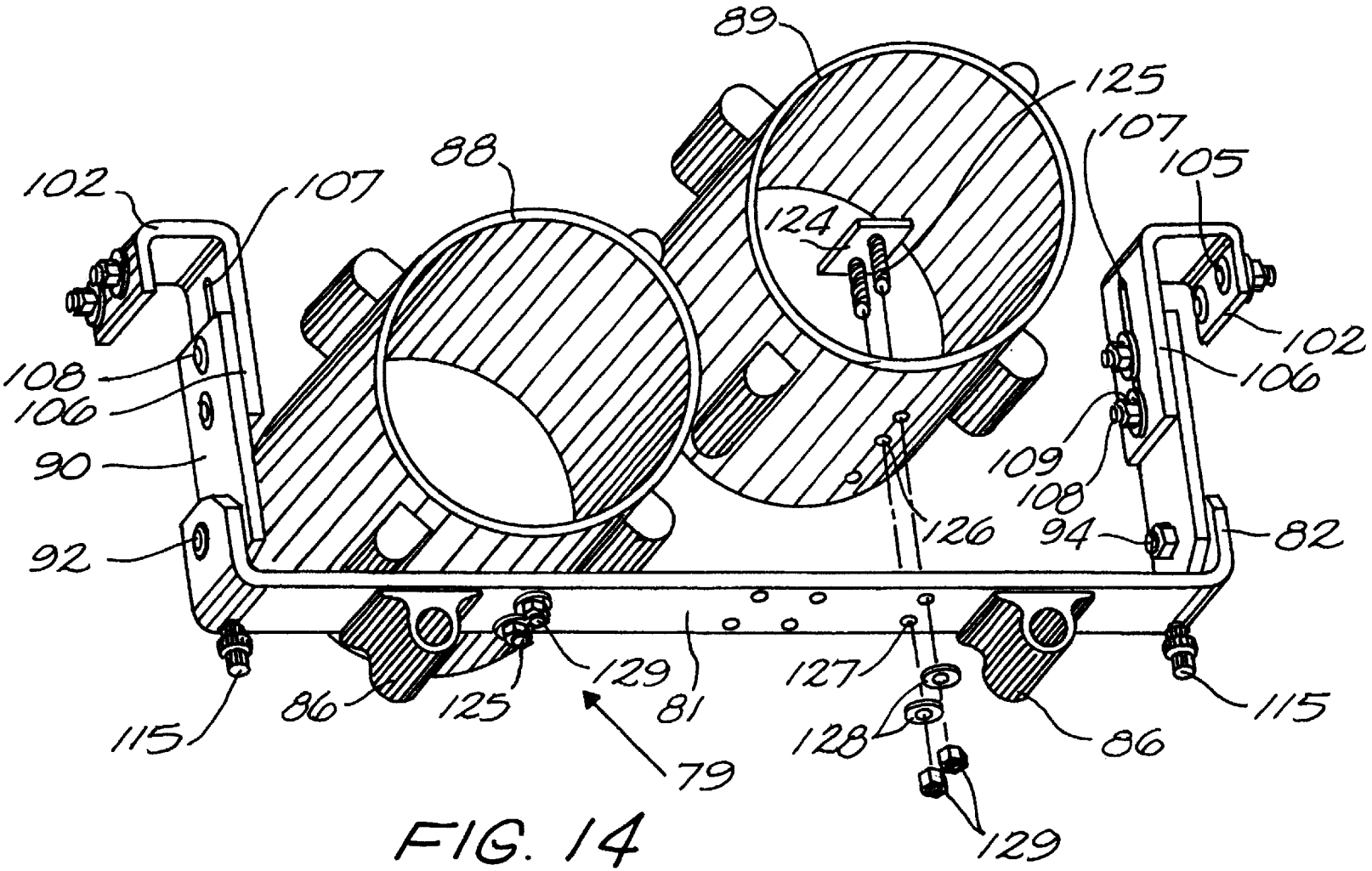
FIG. 14 is an isometric view of still another embodiment of supporting hardware supporting an array of drums, as in the marching drum assembly shown in FIG. 11 illustrating the hardware for connection of two drums to the back bar of the support.

FIGS. 13 and 14 show details of the connection of drum 88 (FIG. 9) or drums 88 and 89 (FIG. 11) to back bar 81. In these Figures, the same reference numbers are used for the same components in FIGS. 9–12.

In FIG. 13 there are shown details of the connection of drum 88 to hinge back bar 81. In this embodiment, a hollow standoff or spacer boss 117 spaces drum 88 from back bar 81. Bolts 118 extend through washers 119, holes 120 in the drum wall, spacer boss 117, holes 121 in hinge back bar 81, washers 122, and are secured by nuts 123. While this connection is shown for a single drum 88 in FIG. 13, it could also be used in assembling two drums 88 and 89.

In FIG. 14 there are shown details of the connection of two drums 88 and 89 to hinge back bar 81. In this embodiment, the drums are mounted flush against back bar 81. On the right side of FIG. 14, drum 89 and back bar 81 are shown in exploded relation. A retaining plate 124 is shown with bolts 125 aligned with holes 126 in the shell of drum 89 and holes 127 in back bar 81. Bolts 125 extend through washers 128 and are secured on the back bar by nuts 129. On the left side of FIG. 14, drum 88 is shown assembled by the connection shown in the exploded portion of the Figure. As noted above, the standoff boss 117 of FIG. 13 could be used in this connection and could be omitted in FIG. 13 and this flush connection used.

Another Hinge Assembly

Figure 15:
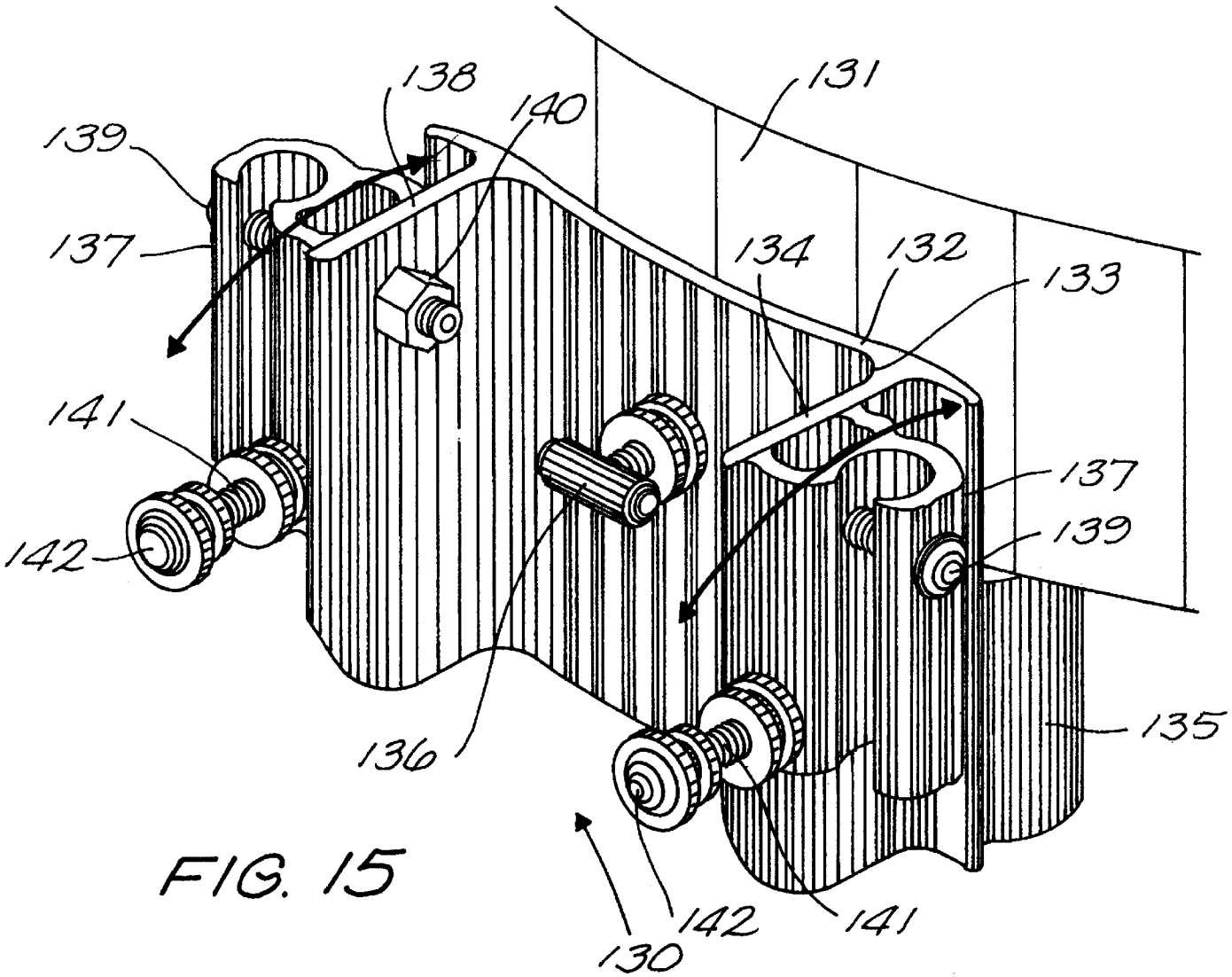
FIG. 15 is an isometric view of another embodiment of hinge secured on a drum shell.

Another hinge assembly is shown in FIG. 15 for connecting a drum to J-rods on a pedestal support or on a marching vest or T-bar carrier. Hinge assembly 130 is shown mounted on a drum 131 to allow pivoting of the drum on its support.

Figure 17:
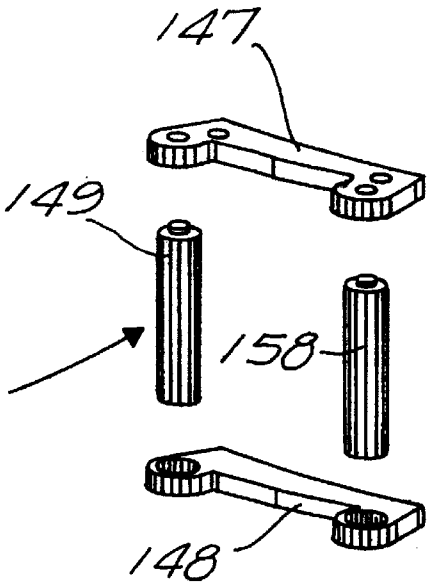
FIG. 17 is a detail, exploded view of the auxiliary supporting rods shown in FIG. 16.
Figure 16:
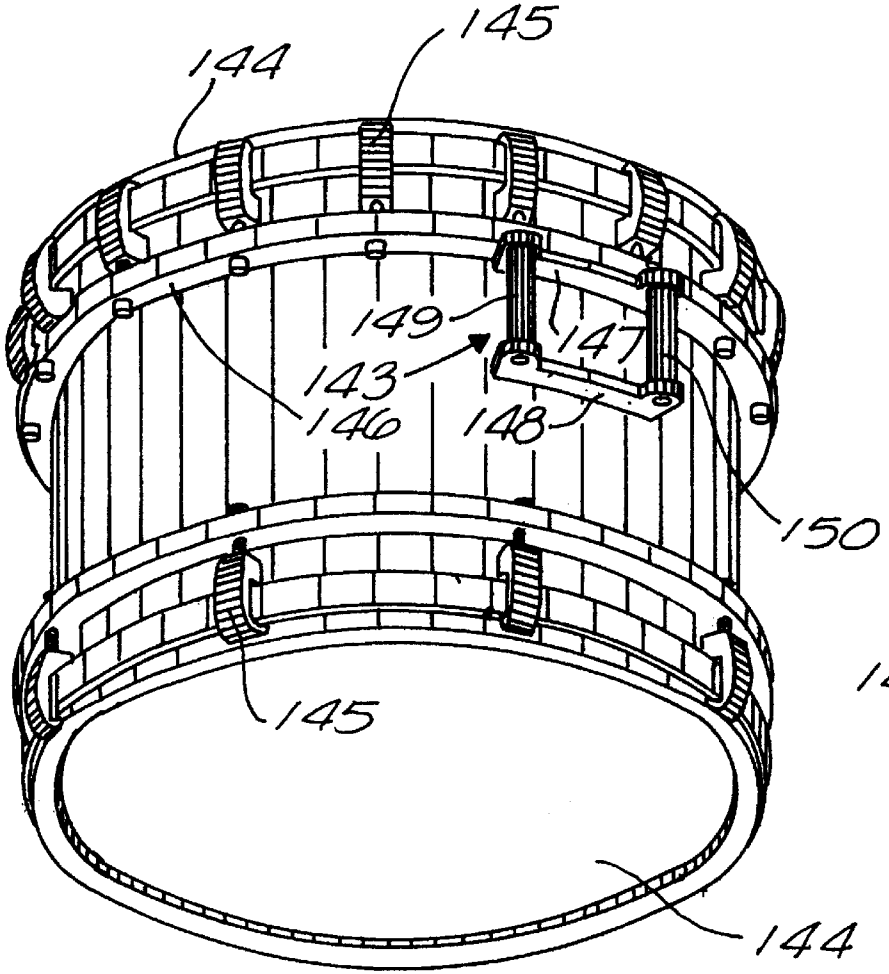
FIG. 16 is an isometric view of a drum shell having auxiliary rods supported thereon as supports for a hinge.

Hinge assembly 130 comprises a fixed member 132 that is a one-piece extrusion having a back portion 133 with parallel upstanding wall members 134 and rearward facing curved wall portions 135 that fit over two of the tension rods on the drum or rods 149 and 150 of the embodiment in FIGS. 16–17. Back portion 133 has a curvature allowing it to fit against drum 131. Thumbscrew 136 secures back portion 133 to the drum shell.

Two J-rod clamping receptacles 137 are supported for pivotal movement on sidewalls 134 of fixed hinge member 132. Receptacles 137 are cast or extruded and have an open edge portion which can flex to clamp J-rods or posts adjustably. Receptacles 137 have a cylindrical inner surface. The base 138 of receptacles 137 is hollow and maintains the receptacle in spaced relation to sidewalls 134 of fixed hinge member 132. Hinge bolts 139 extend through receptacles 137 into sidewalls 134 where they are secured by nuts 140. Bolts 141, operated by knobs 142, extend through the hollow base of receptacles 137 to engage wall 132 of fixed hinge member 130. Adjustment of bolts 141 pivots hinged receptacles 137 outward or inward to a selected position.

Operation

The operation of this supporting hardware should be apparent but will be described in some detail for clarity of understanding. Referring to FIG. 15, hinge assemble 130 is supported on drum 131 by clamping on the drum tension rods or rods 149 and 150 of the embodiment in FIGS. 16–17. Pivoted hinge receptacles 137 support the drum 131 on J-rods (not shown) on a supporting pedestal or on a marching carrier. Drum 131 is pivoted to a selected position by operation of knobs 142 on bolts 141 as described above.

Adaptor for Fastening Hinge to Drums

In FIG. 15, the hinge assembly is shown for attachment to tension rods on a drum 131. FIGS. 16 and 17 show an adaptor 143 to facilitate attachment to a drum that does not have tension rods extending from one side of the drum to the other. In this view, the drum has drumheads 144 on opposite sides secured by drum clamps 145 to rim 146. In this embodiment, adaptor 143 comprises spacer plates 147 and 148 securing rods 149 and 150 is spaced relation corresponding to the spacing of clamping walls 135 in the hinge of FIG. 15. Spacer plate 147 is secured to the ends of two adjacent bolts securing drum clamps 145 in place.

Adjustable Hinge Plates and Drum Supports

In FIGS. 18–22. There are shown arrangements for adjustment to the position of drums on the hinge bars and for adjustment of the length of the hinge bars.

Figure 18:
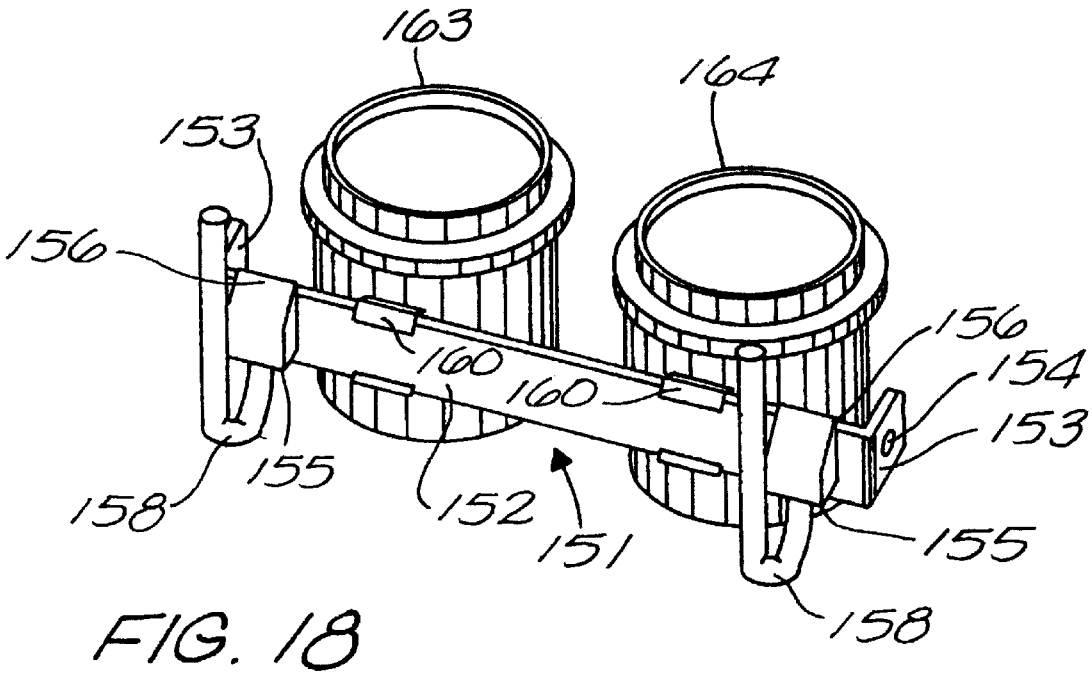
FIG. 18 is an isometric view of still another embodiment of supporting hardware supporting an array of drums, illustrating the hardware for slidably positioning two drums on the back bar of the support.
Figures 19, 20:
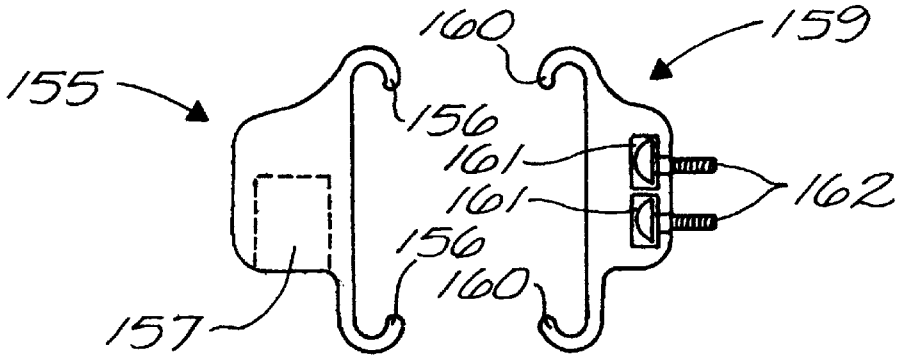
FIG. 19 is a view in side elevation of a slidable J-rod receiving bracket in the hardware shown in FIG. 18.
FIG. 20 is a view in side elevation of a slidable drum-supporting racket in the hardware shown in FIG. 18.

In FIG. 18, a hinge assembly 151 comprises a back bar 152 that is the fixed member of the hinge. Back bar 152 has end portions 153, bent at a right angle thereto, with holes 154 providing a pivot for the hinge. The remainder of the hinge is not shown but may use any of the pivoted hinge members described above for supporting the array of drums for pivotal movement.

J-rod receptacles 155 have hooked edge portions 156 for slidable support on back bar 152. Receptacles 155 have a cylindrical recess 157 to receive a J-rod 158 on a pedestal support or on a vest-type carrier or a T-bar type carrier. Drum supporting receptacles 159 have hooked edge portions 160 for slidable support on back bar 152. Receptacles 159 have recesses 161 to receive bolts 162 for connection to drums 163 and 164.

Receptacles 155 are slidable on back bar 152 to permit variation in the lateral spacing of J-rods 158. Receptacles 159 are slidable on back bar 152 to permit variation in the lateral spacing of drums 163 and 164.

Figure 22:
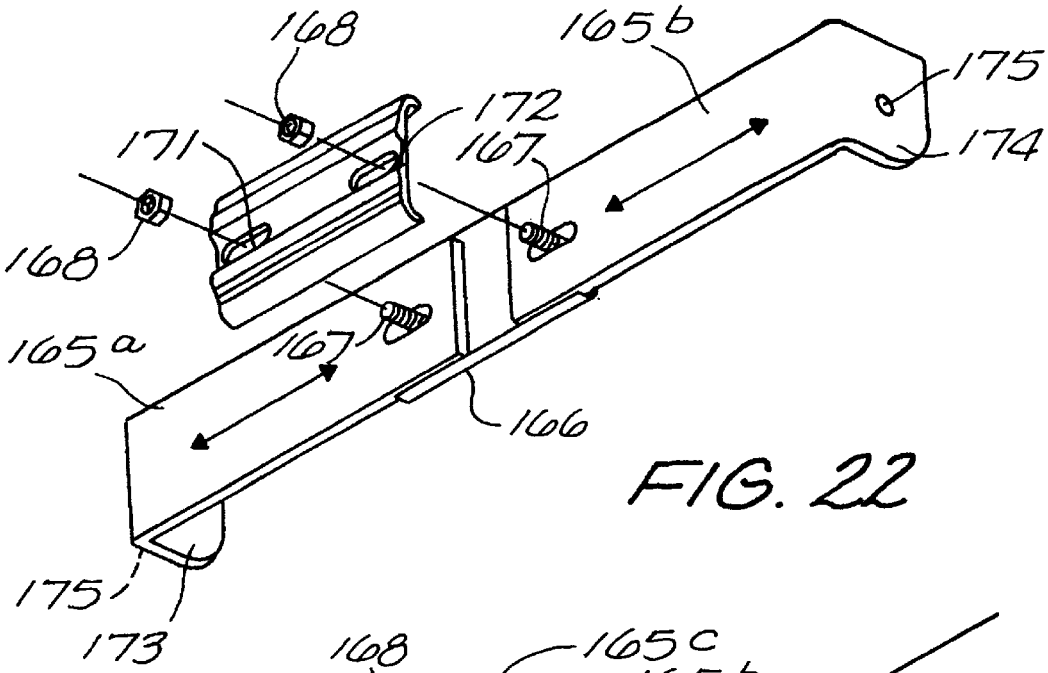
FIG. 22 is an exploded view, partially assembled, of the adjustable back bar shown in FIG. 21.
Figure 21:
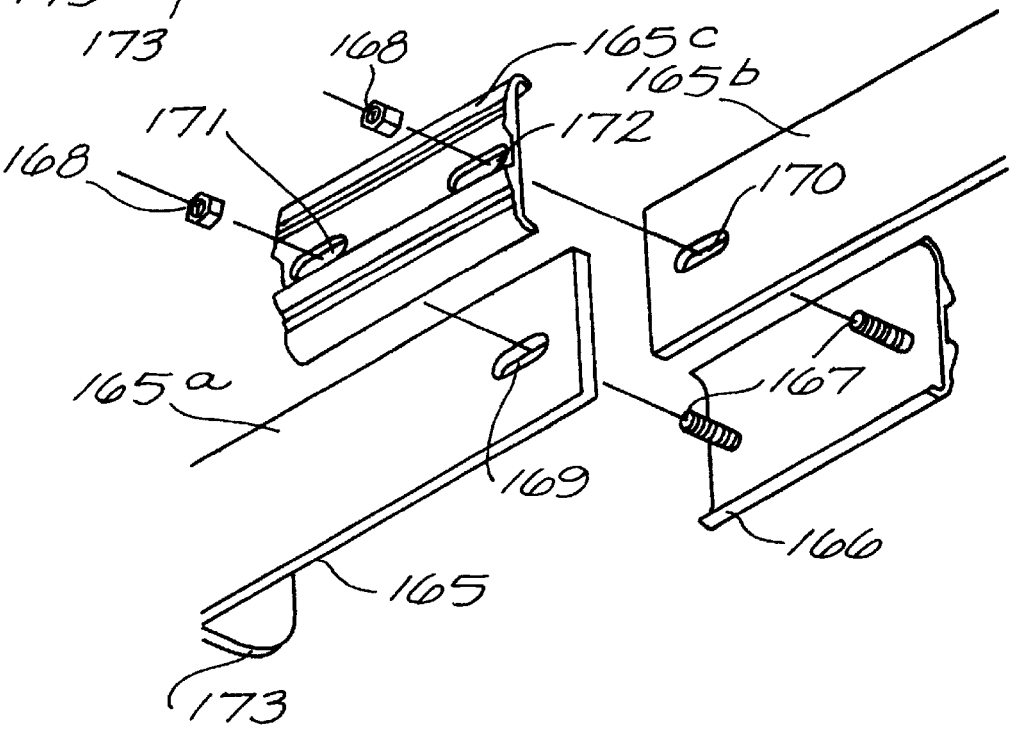
FIG. 21 is an exploded view of an adjustable back bar for the hardware shown in FIG. 18.

FIGS. 21 and 22 show a hinge back bar that is adjustable in length. Hinge back bar 165 comprises end bar portions 165*a* and 165*b* and connecting bar portion 165*c*. Connecting plate portion 166 is fastened to connecting bar portion 165*c* by bolts 167 and nuts 168. Slots 169 and 170 in end bar portions 165*a* and 165*b* match with slots 171 and 172 in connecting bar portion 165*c*.

The end bar portions 165*a* and 165*b* have bent portions 173 and 174 with holes that receive bolts for pivotal connection to the hinge bar portions of the hinge assembly. Back bar 165, assembled as described, is adjustable in length as indicated by the arrows in FIG. 22. This adjustable back bar 165 may be used with any of the hardware described above for supporting drum supporting receptacles and J-rod supporting receptacles.

Hardware for Drum Rotation

Figure 24:
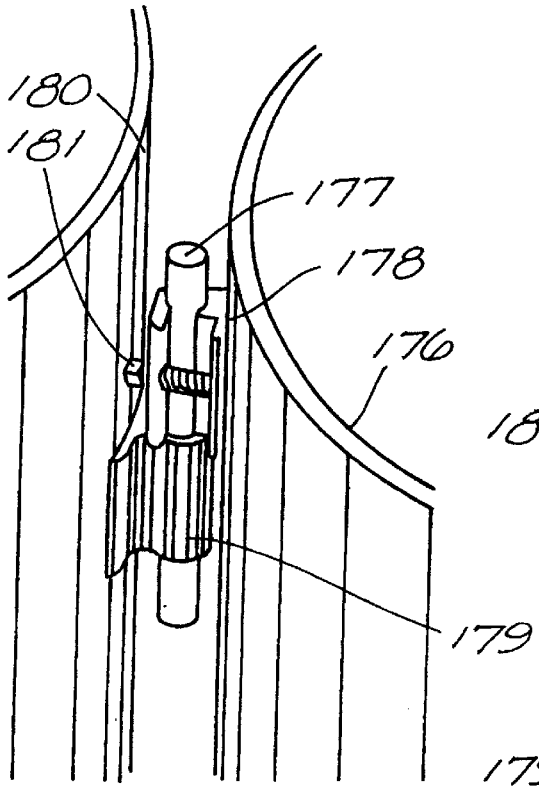
FIG. 24 is an isometric view showing the hardware of FIG. 23 in assembled position connecting a pair of drums for pivotal movement.
Figure 23:
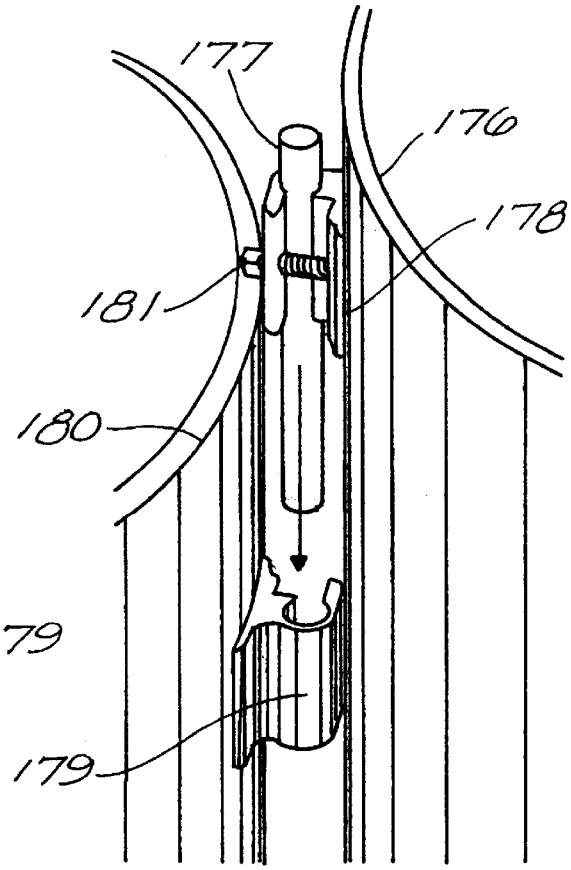
FIG. 23 is an exploded isometric view showing an arrangement for connecting a pair of drums for pivotal movement.

In the various views described above, the array of drums has the individual drums are secured together in fixed relation with the outermost drums in the array supported on the hinge bars. In FIGS. 23 and 24, drums are shown with connections that permit pivotal movement of one drum relative to the next.

Drum 17, in FIG. 23, has a connecting rod 177 with its upper end portion secured in clamping receptacle 178. Another end portion of connecting rod 177 is positioned to be fitted into clamping receptacle 179 that is secured on an adjacent drum 180 of the drum assembly 40. FIG. 24 shows the connecting rod 177 secured in receptacle 179. This connection of the receptacle in the drum is substantially as shown and described for FIG. 8. Bolts 181 extend through each receptacle 178, 179 and permit tightening or loosening of the clamp. This clamping receptacle is available commercially and is described more completely in FIGS. 39–41, 47–49, and 52–55 of May U.S. Pat. No. 6,028,257. The connection of drums 176 and 180 by J-rod clamps 178 and 179 permits easy rotational adjustment of the drums.

While this invention has been described fully and completely, with special emphasis on several preferred embodiments and/or applications, it should be understood that within the scope of the appended claims, the invention may be practiced otherwise than as specifically described.

What is claimed is:

1. Supporting hardware, for an array of drums secured together as a group for use with an external support having J-rods supported thereon, comprising:

supporting means operable to be secured to at least two separate drums of said group of drums for supporting the same, a hinge back bar member, a pair of receptacle members on said hinge back bar member, each having a recess for receiving the ends of J-rods on said external support for supporting said array of drums, a pivot connection between the ends of said hinge back bar member and said supporting means for pivotal movement therebetween, and said supporting means being movable toward and away from said hinge back bar member to vary the position of said drum array.

2. Supporting hardware for an array of drums according to claim 1 in which:

said supporting means includes means for angular adjustment of said pivotal connection for tilting said drum array relative to said hinge back bar member.

3. Supporting hardware for an array of drums according to claim 1 in which:

said supporting means comprises a pair of hinge bar members securable to at least two drums of said array of drums, including means to permit movement of said drum array relative to said hinge back bar.

4. Supporting hardware for an array of drums according to claim 3 in which:

said supporting means comprises a pair of hinge bar members securable to at least two drums of said array of drums, said hinge bar members being pivotally connected to opposite ends of said hinge back bar member, receptacle members on said hinge bar members, a connecting rod supported on said hinge bar receptacle members and connected to said two drum members, said connecting rod being slidable to move said drum array inward and outward relative to said hinge back bar, and said supporting means including means for angular adjustment of said hinge bar members for tilting said drum array relative to said back bar member.

5. Supporting hardware for an array of drums according to claim 4 in which:

said receptacle members on said hinge bars are hollow J-rod clamping receptacles.

6. Supporting hardware for an array of drums according to claim 2 in which:

said supporting means comprises a pair of hinge bar members securable directly to at least two drums of said array of drums, each said hinge bar member being of two parts connected together for sliding movement, one of said hinge bar member parts being pivotally connected to opposite ends of said hinge back bar member, another of said hinge bar member parts being connected to said two drum members, and said connection between said hinge bar member parts being slidable to move said drum array inward and outward relative to said hinge back bar.

7. Supporting hardware for an array of drums according to claim 6 in which;

said supporting means includes means for angular adjustment of said hinge bar members for tilting said drum array relative to said hinge back bar member.

8. Supporting hardware for an array of drums according to claim 1 in which:

said hinge back bar member includes means for adjusting the position of drums secured thereon.

9. Supporting hardware for an array of drums according to claim 8 in which:

said hinge back bar member is adjustable in length for adjusting the position of drums secured thereon.

10. Supporting hardware for an array of drums according to claim 9 in which:

said hinge back bar member comprises at least two portions secured together and adjustable in length for adjusting the position of drums secured thereon.

11. Supporting hardware for an array of drums according to claim 8 in which:

said drum position adjusting means comprises two supporting members shaped to slide on said hinge back bar member and supporting drums thereon whereby movement of said supporting members adjusts the position of drums secured thereon.

12. Supporting hardware for an array of drums according to claim 11 additionally including:

two supporting members shaped to slide on said hinge back bar member and having receptacles receiving J-bars from external supports whereby movement of said receptacles adjusts the position of said supports.

13. In combination, supporting hardware, for an array of drums secured together as a group for use with an external support having J-rods supported thereon, comprising:

supporting means secured to at least two separate drums of said group of drums for supporting the same, a hinge back bar member, at least one drum supported on said hinge back bar, a pair of receptacle members on said hinge back bar member, each having a recess for receiving the ends of J-rods on said external support for supporting said array of drums, a pivot connection between the ends of said hinge back bar member and said supporting means for pivotal movement therebetween, and said supporting means being movable toward and away from said hinge back bar member to vary the position of said drum array.

14. A combination according to claim 13 in which, said at least one drum is supported on said hinge back bar by bolts securing the same flush against said hinge back bar.

15. A combination according to claim 13 in which, said at least one drum is positioned on said hinge back bar and spaced therefrom by a spacer member, and bolts extending through the drum shell and said spacer member secure the drum spaced from said hinge back bar.

16. A combination according to claim 13 additionally including, means connecting at least two drums of said drum array for pivotal movement relative to each other.

17. A combination according to claim 16 in which, drum connecting means comprises a J-rod receptacle on each drum and a connecting rod clamped therein to permit pivotal movement of the drums relative to each other.

* * * * *

UNITED STATES PATENT AND TRADEMARK OFFICE

CERTIFICATE OF CORRECTION

PATENT NO. : 6,403,869 B2
APPLICATION NO. : 09/756479
DATED : June 11, 2002
INVENTOR(S) : Randall L. May It is certified that error appears in the above-identified patent and that said Letters Patent is hereby corrected as shown below:

Title page, item [63] should read as follows:

This application is a continuation-in-part of Ser. No. 09/507,800 filed Feb. 22, 2000, now U.S. Pat. No. 6,172,290 issued Jan. 9, 2001, which is a continuation-in-part of Ser. No. 09/497,266 filed Feb. 3, 2000, now U.S. Pat. No. 6,329,583 issued Dec. 11, 2001, which is a continuation-in-part of Ser. No. 09/497,265 filed Feb. 3, 2000, now U.S. Pat No. 6,323,407 issued Nov. 27, 2001, which is a continuation-in-part of Ser. No. 08/976,999 filed Nov. 24,1997, now U.S. Pat No. 6,028,257 issued Feb. 22, 2000, which is a continuation-in-part of Ser. No. 08/588,244, filed on Jan. 18,1996, now U.S. Pat No. 5,691,492, issued Nov. 25, 1997.

Signed and Sealed this
Twenty-fourth Day of May, 2011

David J. Kappos

David J. Kappos
*Director of the United States Patent and Trademark Office*